US007733312B2

(12) United States Patent
Moon et al.

(10) Patent No.: US 7,733,312 B2
(45) **Date of Patent: *Jun. 8, 2010**

(54) LIQUID CRYSTAL DISPLAY WITH A STRUCTURE FOR REDUCING CORROSION OF DISPLAY SIGNAL LINES

(75) Inventors: Sung-Jae Moon, Seoul (KR); Sin-Gu Kang, Suwon (KR); Dong-Gyu Kim, Yongin (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 750 days.

This patent is subject to a terminal disclaimer.

(21) Appl. No.: 11/524,601

(22) Filed: Sep. 21, 2006

(65) Prior Publication Data

US 2007/0013637 A1 Jan. 18, 2007

Related U.S. Application Data

(63) Continuation of application No. 10/615,658, filed on Jul. 9, 2003, now Pat. No. 7,133,039.

(30) Foreign Application Priority Data

Nov. 19, 2002 (KR) ..... 10-2002-0071921

(51) Int. Cl.
*G09G 3/36* (2006.01)

(52) U.S. Cl. ..... 345/87; 345/89; 345/94; 345/98; 345/100

(58) Field of Classification Search ..... 345/55, 345/58, 87, 89, 94, 98–100, 204, 206, 211, 345/213; 349/139, 149, 192; 326/62, 80, 326/105

See application file for complete search history.

(56) References Cited

U.S. PATENT DOCUMENTS

| | | | | |
|---|---|---|---|---|
| 5,703,617 | A * | 12/1997 | Callahan et al. | 345/98 |
| 5,796,379 | A * | 8/1998 | Enomoto et al. | 345/89 |
| 5,926,157 | A * | 7/1999 | Moon | 345/89 |
| 6,365,941 | B1 * | 4/2002 | Rhee | 257/357 |
| 6,750,926 | B2 * | 6/2004 | Ohgiichi et al. | 349/40 |
| 6,977,711 | B2 * | 12/2005 | Kwak et al. | 349/192 |
| 7,095,394 | B2 * | 8/2006 | Hong | 345/89 |
| 7,106,292 | B2 * | 9/2006 | Moon | 345/100 |
| 7,133,039 | B2 * | 11/2006 | Moon et al. | 345/211 |
| 7,193,597 | B2 * | 3/2007 | Sunohara | 345/98 |
| 7,209,104 | B2 * | 4/2007 | Nakajima et al. | 345/89 |
| 7,453,428 | B2 * | 11/2008 | Imajo et al. | 345/87 |

(Continued)

FOREIGN PATENT DOCUMENTS

JP 08095077 4/1996

(Continued)

*Primary Examiner*—Prabodh M Dharia
(74) *Attorney, Agent, or Firm*—F. Chau & Associates, LLC

(57) ABSTRACT

A liquid crystal display, in accordance with the present invention, includes a substrate and a plurality of driving signal lines formed on the substrate. The plurality of driving signal lines includes a plurality of voltage transmission lines. Each voltage transmission line carries one of a plurality of predetermined voltages and the voltage transmission lines are arranged on the substrate according to the magnitudes of the predetermined voltages that the voltage transmission lines carry.

9 Claims, 7 Drawing Sheets

U.S. PATENT DOCUMENTS

| | | | | |
|---|---|---|---|---|
| 2001/0020988 | A1* | 9/2001 | Ohgiichi et al. | 349/54 |
| 2001/0033259 | A1* | 10/2001 | Sakaguchi | 345/87 |
| 2002/0054004 | A1 | 5/2002 | Moon et al. | 345/87 |
| 2002/0126082 | A1* | 9/2002 | Matsuzaki | 345/98 |
| 2003/0011548 | A1* | 1/2003 | Nakajima | 345/87 |
| 2003/0011558 | A1* | 1/2003 | Motegi et al. | 345/100 |
| 2003/0058208 | A1* | 3/2003 | Kawamura et al. | 345/87 |
| 2003/0122761 | A1* | 7/2003 | Hong | 345/89 |
| 2003/0227433 | A1* | 12/2003 | Moon | 345/100 |
| 2006/0038763 | A1* | 2/2006 | Doi et al. | 345/98 |
| 2006/0077333 | A1* | 4/2006 | Imajo et al. | 349/149 |
| 2006/0256066 | A1* | 11/2006 | Moon | 345/100 |
| 2009/0195490 | A1* | 8/2009 | Imajo et al. | 345/94 |

FOREIGN PATENT DOCUMENTS

| | | | |
|---|---|---|---|
| JP | 09-026593 | | 1/1997 |
| JP | 09-054329 | | 2/1997 |
| JP | 10-170933 | | 6/1998 |
| JP | 11-142871 | | 5/1999 |
| JP | 2002090771 | | 3/2002 |
| JP | 2002-140042 | | 5/2002 |
| KR | 1999-0000069 | * | 5/2000 |
| KR | 1020020017322 | | 3/2002 |
| KR | 1020020030718 | | 4/2002 |
| KR | 1020020042996 | | 6/2002 |

* cited by examiner

LIQUID CRYSTAL DISPLAY WITH A STRUCTURE FOR REDUCING CORROSION OF DISPLAY SIGNAL LINES

CROSS-REFERENCE TO RELATED APPLICATION

This application is a Continuation of U.S. patent application Ser. No. 10/615,658, filed on Jul. 9, 2003, now U.S. Pat. No. 7,133,039, and which claims priority to Korean Patent Application No. 2002-71921, filed Nov. 19, 2002 in the Korean Intellectual Property Office (KIPO), both of which are fully incorporated herein by reference.

FIELD OF THE INVENTION

The present invention relates to a liquid crystal display and, more specifically, to a liquid crystal display with a structure for reducing corrosion of display signal lines.

BACKGROUND OF THE INVENTION

The liquid crystal display (LCD) is one of the most common types of flat panel displays (FPDs). LCDs are used in notebook or laptop computers and have also become popular in desktop computer monitors. LCDs are lightweight and occupy less space than conventional cathode ray tube (CRT) displays.

The general structure of an LCD consists of a pair of panels including field generating electrodes and polarizers, and a liquid crystal (LC) layer that is positioned between the panels and subject to an electric field generated by the electrodes. Variations in the field strength change the molecular orientation of the LC layer. For example, upon application of an electric field, the molecules of the LC layer align with the field and polarize light passing through the LC layer. A polarized filter positioned over the electrodes blocks the polarized light, creating a dark area. The dark area represents a desired image, such as an alphanumeric character.

It is common that the field generating electrodes include a plurality of pixel electrodes arranged in a matrix and a common electrode. The common electrode and the pixel electrodes may be disposed on different panels. The panel including the pixel electrodes also may include a plurality of switching elements, such as thin film transistors (TFTs). The TFTs are connected to the pixel electrodes and to a plurality of display signal lines, including gate lines extending in rows and data lines extending perpendicular to the gate lines in columns.

A signal controller and voltage generators may be provided on printed circuit boards (PCBs) located out of the panels. In addition, gate driving and data driving integrated circuits (ICs) may be provided on flexible printed circuits (FPCs) disposed between the PCBs and the panels. There may be separate gate and data PCBs and gate and data driving ICs respectively disposed between the panels and the gate and data PCBs.

In operation, the signal controller is supplied with image signals and input control signals for controlling the display of the image signals. On the basis of the received image signals and input control signals, the signal controller provides gate control signals to the gate driving ICs and processed image signals and data control signals to the data driving ICs. In response to the gate control signals, the gate driving ICs supply voltage from the voltage generator to the gate lines, which turn on the switching elements or TFTs. Similarly, in response to the data control signals, the data driving ICs convert image data to analog voltages and apply these data voltages to the data lines. The data voltages are supplied to corresponding pixel electrodes via the turned on switching elements so as to generate the electric fields required for the desired images.

Some LCDs include only the data PCB without the gate PCB. In this case, a plurality of signal lines for signal communication between the gate driving ICs and the signal controller and the voltage generator may be provided on the data FPC films and the panels.

Some LCDs have neither a gate PCB nor a gate FPC film. In this case, the gate driving ICs may be mounted on one of the panels. The data driving ICs also may be mounted on the panel. This design is known as chip-on-glass (COG). As a result of this configuration, the panel includes a plurality of signal lines for interconnection between the gate driving ICs. The data driving ICs mounted on the panel can still receive signals via data FPC films.

As described above, several signal lines are required to transmit various control signals and voltages to the gate and data driving ICs. These signal lines are subject to corrosion by, for example, electrolysis when moisture permeates into the panels. Therefore, there exists a need in the art for a configuration of driving signal lines that minimizes corrosion of same. There also exists a need in the art for a configuration of LCD components and lines that allows for testing of potentially defective gate or data lines.

SUMMARY OF THE INVENTION

A liquid crystal display, in accordance with the present invention, includes a first substrate and a plurality of driving signal lines formed on the first substrate. The plurality of driving signal lines includes a plurality of voltage transmission lines. Each voltage transmission line carries one of a plurality of predetermined voltages and the voltage transmission lines are arranged on the first substrate according to the magnitudes of the predetermined voltages that the voltage transmission lines carry.

In alternate embodiments, the voltage transmission lines may be sequentially arranged based on increasing or decreasing magnitude of the predetermined voltages carried by the voltage transmission lines. The driving signal lines may further include a plurality of control signal lines. The plurality of control signal lines may be positioned adjacent to the plurality of voltage transmission lines or disposed in between a first voltage transmission line and a second voltage transmission line, wherein a voltage carried by the control signal lines is equal to the a voltage carried by one of the first and second voltage transmission lines. The predetermined voltages may be one of a common voltage, a gate-off voltage, a gate-on voltage, a ground voltage, and a supply voltage. The liquid crystal display may further include a signal controller for generating one of gate control signals and data control signals. The gate and data control signals may be respectively transmitted via at least one gate control signal line and at least one data control signal line. The liquid crystal display may also include a common voltage generator for generating a common voltage transmitted via a common voltage transmission line, a driving voltage generator for generating one of a gate-on voltage and a gate-off voltage respectively transmitted via a gate-on voltage transmission line and a gate-off voltage transmission line, and a gray voltage generator for generating at least one gray voltage transmitted via a gray voltage transmission line. The display may further include a gate driver including a gate driving integrated circuit for receiving the gate control signals and one of the gate-on voltage and the gate-off voltage, a data driver including a data driving integrated circuit for receiving the data control signals and the at least one gray voltage, and an electrode for receiving the common voltage. The gate driver or the data driver may be disposed on one of the first substrate and a flexible printed circuit film. One of the signal controller, the driving voltage generator, the common voltage generator and the gray voltage generator may be disposed on a printed circuit board. A first electrode and a switching element may be formed on the first substrate, wherein the first electrode is electrically connected to the switching element. The switching element may be a thin film transistor. A plurality of display signal lines, including at least one gate line and at least one data line intersecting the at least one gate line, may be formed on the first substrate and electrically connected to the switching element. A second substrate may be spaced apart from the first substrate by a gap, the gap including liquid crystal and a second electrode may be formed on the second substrate. At least one contact assistant may be connected to an end portion of one of the at least one gate line and the at least one data line. In addition, at least one voltage transmission line may include at least one pad at an end thereof for defect testing of display signal lines and a contact assistant connected to the at least one pad. A first pad may be connected to an end of a first voltage transmission line carrying a first voltage of the plurality of predetermined voltages and a second pad may be connected to an end of a second voltage transmission line carrying a second voltage of the plurality of predetermined voltages. An isolated pad may be interposed between the first and second pads, wherein the isolated pad is electrically connected to at least one redundant driving signal line and the at least one redundant driving signal line carries a voltage equal to the higher one of the first and second voltages.

Another liquid crystal display, in accordance with the present invention, includes a first substrate, and a plurality of control signal lines and voltage transmission lines formed on the first substrate. Each voltage transmission line carries one of a plurality of predetermined voltages and the voltage transmission lines are arranged on the first substrate according to the magnitudes of the predetermined voltages that the voltage transmission lines carry. A switching element and a plurality of display signal lines are also formed on the first substrate. The plurality of display signal lines is electrically connected to the switching element and includes at least one gate line and at least one data line intersecting the at least one gate line.

In alternate embodiments, the voltage transmission lines may be sequentially arranged based on increasing or decreasing magnitude of the predetermined voltages carried by the voltage transmission lines. The plurality of control signal lines may be positioned adjacent to the plurality of voltage transmission lines or disposed in between a first voltage transmission line and a second voltage transmission line, wherein a voltage carried by the control signal lines is equal to the a voltage carried by one of the first and second voltage transmission lines. The predetermined voltages may be one of a common voltage, a gate-off voltage, a gate-on voltage, a ground voltage, and a supply voltage. The liquid crystal display may further include a signal controller for generating one of gate control signals and data control signals. The gate and data control signals may be respectively transmitted via at least one gate control signal line and at least one data control signal line. The liquid crystal display may also include a common voltage generator for generating a common voltage transmitted via a common voltage transmission line, a driving voltage generator for generating one of a gate-on voltage and a gate-off voltage respectively transmitted via a gate-on voltage transmission line and a gate-off voltage transmission line, and a gray voltage generator for generating at least one gray voltage transmitted via a gray voltage transmission line. The display may further include a gate driver including a gate driving integrated circuit for receiving the gate control signals and one of the gate-on voltage and the gate-off voltage, a data driver including a data driving integrated circuit for receiving the data control signals and the at least one gray voltage, and an electrode for receiving the common voltage. The gate driver or the data driver may be disposed on one of the first substrate and a flexible printed circuit film. One of the signal controller, the driving voltage generator, the common voltage generator and the gray voltage generator may be disposed on a printed circuit board. A first electrode may be formed on the first substrate, wherein the first electrode is electrically connected to the switching element. The switching element may be a thin film transistor. A second substrate may be spaced apart from the first substrate by a gap, the gap including liquid crystal and a second electrode may be formed on the second substrate. At least one contact assistant may be connected to an end portion of one of the at least one gate line and the at least one data line. In addition, at least one voltage transmission line may include at least one pad at an end thereof for defect testing of display signal lines and a contact assistant connected to the at least one pad. A first pad may be connected to an end of a first voltage transmission line carrying a first voltage of the plurality of predetermined voltages and a second pad may be connected to an end of a second voltage transmission line carrying a second voltage of the plurality of predetermined voltages. An isolated pad may be interposed between the first and second pads, wherein the isolated pad is electrically connected to at least one redundant driving signal line and the at least one redundant driving signal line carries a voltage equal to the higher one of the first and second voltages.

Another embodiment, in accordance with the present invention, relates to an electronic device with conductive lines for transmitting electrical signals that includes a substrate and a plurality of voltage transmission lines formed on the substrate. Each voltage transmission line carries a voltage and the voltage transmission lines are arranged on the substrate according to the magnitudes of the voltages that the voltage transmission lines carry.

BRIEF DESCRIPTION OF THE DRAWINGS

Preferred embodiments of the invention can be understood in more detail from the following descriptions taken in conjunction with the accompanying drawings in which.

DETAILED DESCRIPTION OF THE PREFERRED EMBODIMENTS

Figure 1:
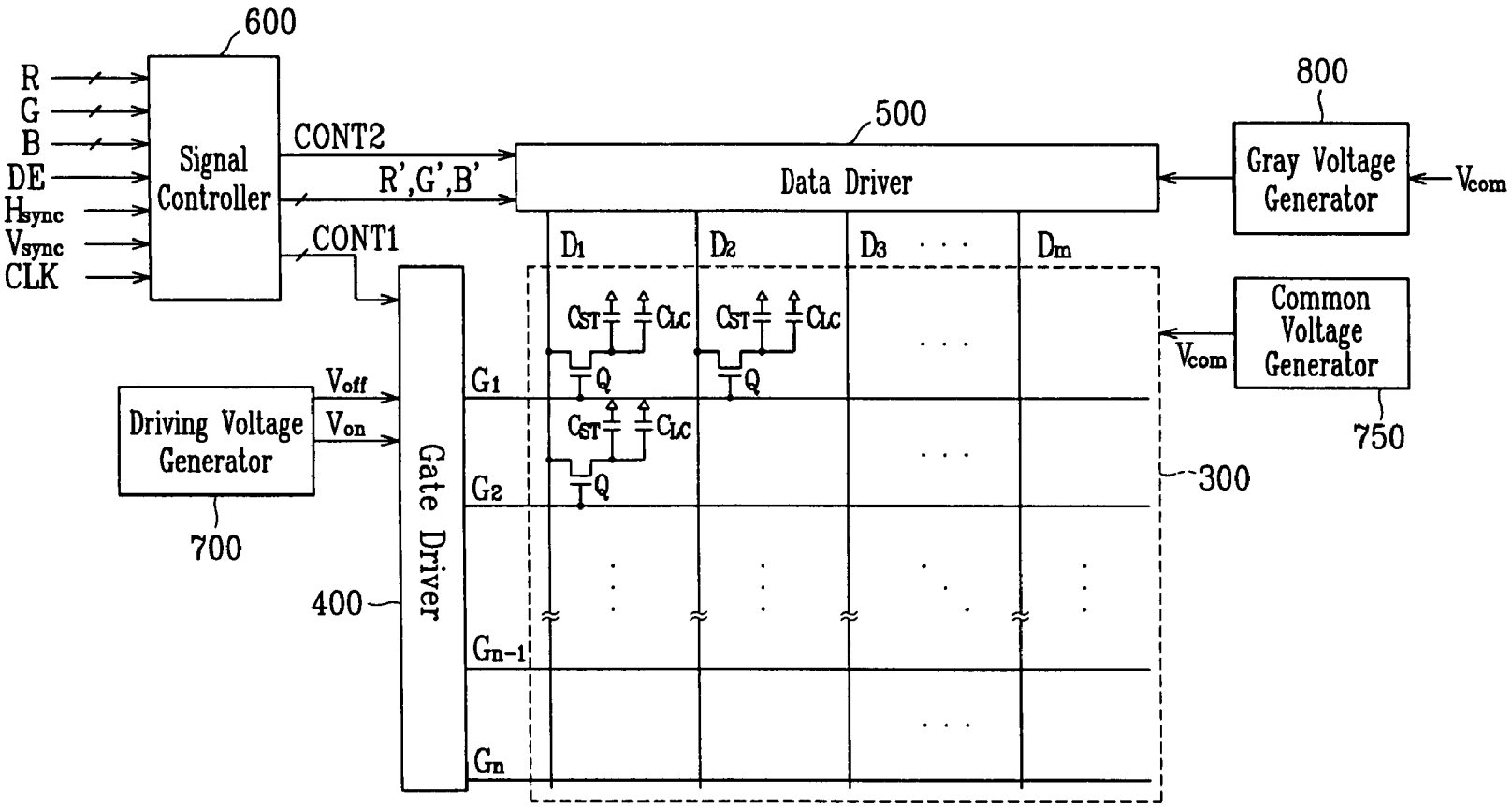
FIG. 1 is a block diagram of an LCD according to an embodiment of the present invention.

Preferred embodiments of the present invention will be described below in more detail with reference to the accompanying drawings. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. It will also be understood that when an element, such as a layer, film, region, substrate or panel is referred to as being "on" another element, it can be directly on the other element or intervening elements may also be present.

The present invention relates to LCDs, and more particularly to a configuration of LCD components that minimizes corrosion and defects of lines used for transmission of voltage and control signals to gate and data drivers. The goal of reducing corrosion of lines is achieved by sequentially arranging voltage transmission lines and control signal lines based on the value of the carrying voltage of each line. A sequential arrangement of lines from high to low voltage, or from low to high voltage, reduces the voltage difference between adjacent driving signal lines. The reduced voltage difference has the effect of reducing corrosion of the signal lines by decreasing electrolysis that occurs when a medium for carrying negative charges (e.g., water) is introduced into the panel assembly.

The sequential arrangement of driving signal lines has an added benefit of allowing placement of the gate-off voltage transmission line at an innermost location from the rest of the signal lines due to its low voltage. The inner location allows the gate-off voltage transmission line to have a large width and, in turn, reduced resistance for stably transmitting the gate-off voltage.

Corrosion reduction of signal lines is also accomplished by the provision of isolated pads interposed between the pads of two voltage transmission lines carrying two different voltages. The isolated pads are connected to redundant signal lines that transmit the higher one of the two voltages being carried by the two adjacent voltage transmission lines. As a result, the voltage difference between the pad of the voltage transmission line carrying the lower voltage and the isolated pad is large, and the voltage difference between the pad of the voltage transmission line carrying the higher voltage and the isolated pad is substantially zero. Therefore, defects or corrosion of the voltage transmission line carrying the higher voltage are prevented at the sacrifice of an isolated pad. U.S. patent application Ser. No. 09/940,429 and Pub. No. 2002/0054004 (and its patent family KR 10-2000-0050548, JP 2001-118139, TW 89120465 and CN 01141110.4) discloses the related art, and is incorporated herein by reference.

The present invention also relates to a configuration of pads at the ends of the gate-off voltage transmission line that allows for testing of potentially defective gate and data lines. Upon application to the pads of a voltage sufficient for turning on the switching elements and application of data test signals to the data lines, an inspector may examine whether the display is consistent with the test signals and determine if any gate or data lines are not functioning.

Figure 2:
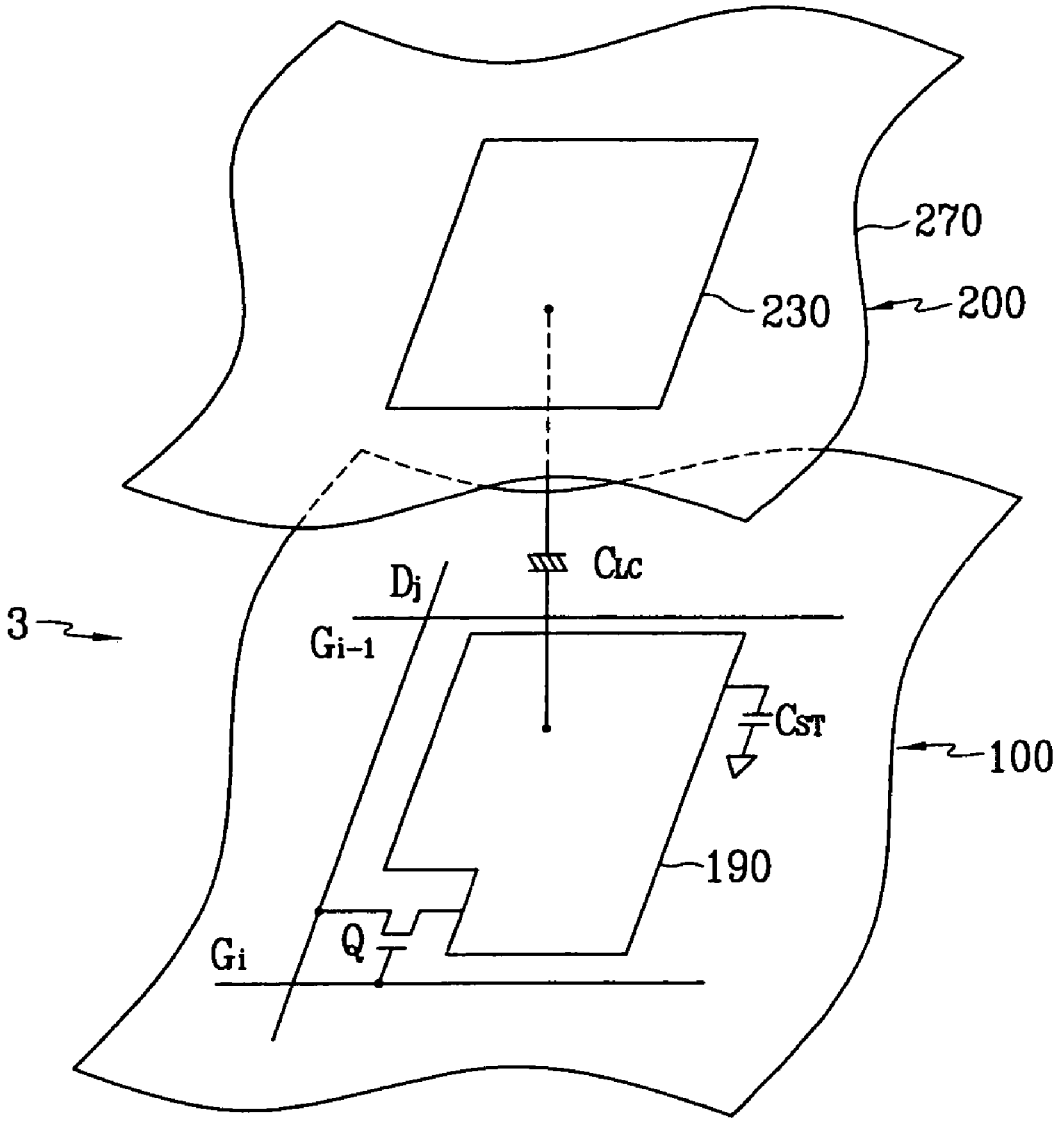
FIG. 2 is an equivalent circuit diagram of a pixel of an LCD according to an embodiment of the present invention.

Referring now to the drawings in which like numerals represent the same or similar elements, FIG. 1 is a block diagram of an LCD according to an embodiment of the present invention, and FIG. 2 is an equivalent circuit diagram of a pixel of an LCD according to an embodiment of the present invention.

As shown in FIG. 1, the LCD includes an LC panel assembly 300. A gate driver 400, a data driver 500 and a common voltage generator 750 are connected to the panel assembly 300. A driving voltage generator 700 is connected to the gate driver 400 and a gray voltage generator 800 is connected to the data driver 500. The driving voltage generator 700 generates a gate-on voltage $V_{on}$ for turning on a switching element Q included in each pixel and a gate-off voltage $V_{off}$ for turning off the switching element Q. The common voltage generator 750 generates a common voltage $V_{com}$ supplied to a common electrode 270 (FIG. 2) and the gray voltage generator 800 generates gray voltages supplied to the data driver 500.

A signal controller 600 is connected to the gate driver 400 and the data driver 500. An external graphic controller (not shown) supplies the signal controller 600 with red, green and blue image signals R, G, B and input control signals for controlling the display of the image. The input control signals may include a vertical synchronization signal $V_{sync}$, a horizontal synchronization signal $H_{sync}$, a main clock CLK, and a data enable signal DE. After generating gate control signals CONT1 and data control signals CONT2 on the basis of the input control signals and processing the image signals R, G, B, the signal controller 600 provides the gate control signals CONT1 to the gate driver 400, and the processed image signals R', G', B' and the data control signals CONT2 to the data driver 500.

The gate control signals CONT1 may include a vertical synchronization start signal STV for indicating the start of a frame, a gate clock signal CPV for controlling the output time of the gate-on voltage $V_{on}$, and an output enable signal OE for defining the gate-on voltage $V_{on}$. The data control signals CONT2 may include a horizontal synchronization start signal STH for indicating the start of a horizontal period, a load signal LOAD for commanding the application of appropriate data voltages to the data lines $D_1$-$D_m$, an inversion control signal RVS for reversing the polarity of the data voltages (with respect to the common voltage $V_{com}$) and a data clock signal HCLK.

As shown in FIGS. 1 and 2, the panel assembly 300 includes a plurality of display signal lines, specifically gate lines $G_1$-$G_m$ and data lines $D_1$-$D_m$. A plurality of pixels are connected to the gate lines $G_1$-$G_n$ and data lines $D_1$-$D_m$ and arranged substantially in a matrix. The panel assembly 300 includes a lower panel or substrate 100, an upper panel or substrate 200 facing the lower panel 100, and a liquid crystal layer 3 interposed between the lower and upper panels 100, 200.

The gate lines $G_1$-$G_n$ and data lines $D_1$-$D_m$ may be provided on the lower panel 100 and respectively transmit gate signals (called scanning signals) and data signals. The gate lines $G_1$-$G_n$ extend substantially in a row direction and are substantially parallel to each other, while the data lines $D_1$-$D_m$ extend substantially in a column direction and are substantially parallel to each other.

Each pixel includes a switching element Q connected to the display signal lines $G_1$-$G_n$ and $D_1$-$D_m$. An LC capacitor $C_{LC}$ and a storage capacitor $C_{ST}$ may be connected to the switching element Q. The storage capacitor $C_{ST}$ may be omitted. The switching element Q may be provided on the lower panel 100 and may have a control terminal connected to one of the gate lines $G_1$-$G_n$, an input terminal connected to one of the data lines $D_1$-$D_m$, and an output terminal connected to the LC and storage capacitors $C_{LC}$, $C_{ST}$.

The LC capacitor $C_{LC}$ may include a pixel electrode 190 on the lower panel 100, a common electrode 270 on the upper panel 200, and the LC layer 3 as a dielectric between the electrodes 190 and 270. The pixel electrode 190 may be connected to the switching element Q, and the common electrode 270 may cover the entire surface of the upper panel 200 and is supplied with a common voltage $V_{com}$. Alternatively, both the pixel electrode 190 and the common electrode 270, which may have shapes of bars or stripes, can be provided on the lower panel 100.

The storage capacitor $C_{ST}$ is an auxiliary capacitor for the LC capacitor $C_{LC}$. The storage capacitor $C_{ST}$ may include the pixel electrode 190 and a separate signal line (not shown), which is provided on the lower panel 100 and overlaps the pixel electrode 190 via an insulator. The separate signal line is supplied with a predetermined voltage such as the common voltage $V_{com}$. Alternatively, the storage capacitor $C_{ST}$ may include the pixel electrode 190 and an adjacent gate line referred to as a previous gate line, which overlaps the pixel electrode 190 via an insulator.

FIG. 2 shows a transistor as a switching element. The transistor may be a metal oxide semiconductor (MOS) transistor and implemented as a thin film transistor (TFT) including an amorphous silicon or polysilicon channel layer.

For a color display, each pixel may represent a single color in accordance with a red, green or blue color filter 230 disposed in an area occupied by the pixel electrode 190. The color filter 230 shown in FIG. 2 is disposed in the corresponding area of the upper panel 200. Alternatively, the color filter 230 is provided on or under the pixel electrode 190 on the lower panel 100. A pair of polarizers (not shown) may be attached on the outer surfaces of the upper panel 200 and the lower panel 100.

The gate driver 400, also called a scanning driver, is connected to the gate lines $G_1$-$G_n$ of the panel assembly 300 and applies gate signals to the gate lines $G_1$-$G_n$, each gate signal being a combination of the gate-on voltage $V_{on}$ and the gate off voltage $V_{off}$.

The data driver 500, also called a source driver, is connected to the data lines $D_1$-$D_m$ of the panel assembly 300 and applies data voltages to the data lines $D_1$-$D_m$. The data voltages are selected from the gray voltages supplied to the data driver from the gray voltage generator 800. The gray voltage generator 800 generates two sets of a plurality of gray voltages related to the transmittance of the pixels. The gray voltages in one set have a positive polarity with respect to the common voltage $V_{com}$, while the gray voltages in the other set have a negative polarity with respect to the common voltage $V_{com}$.

Figure 3:
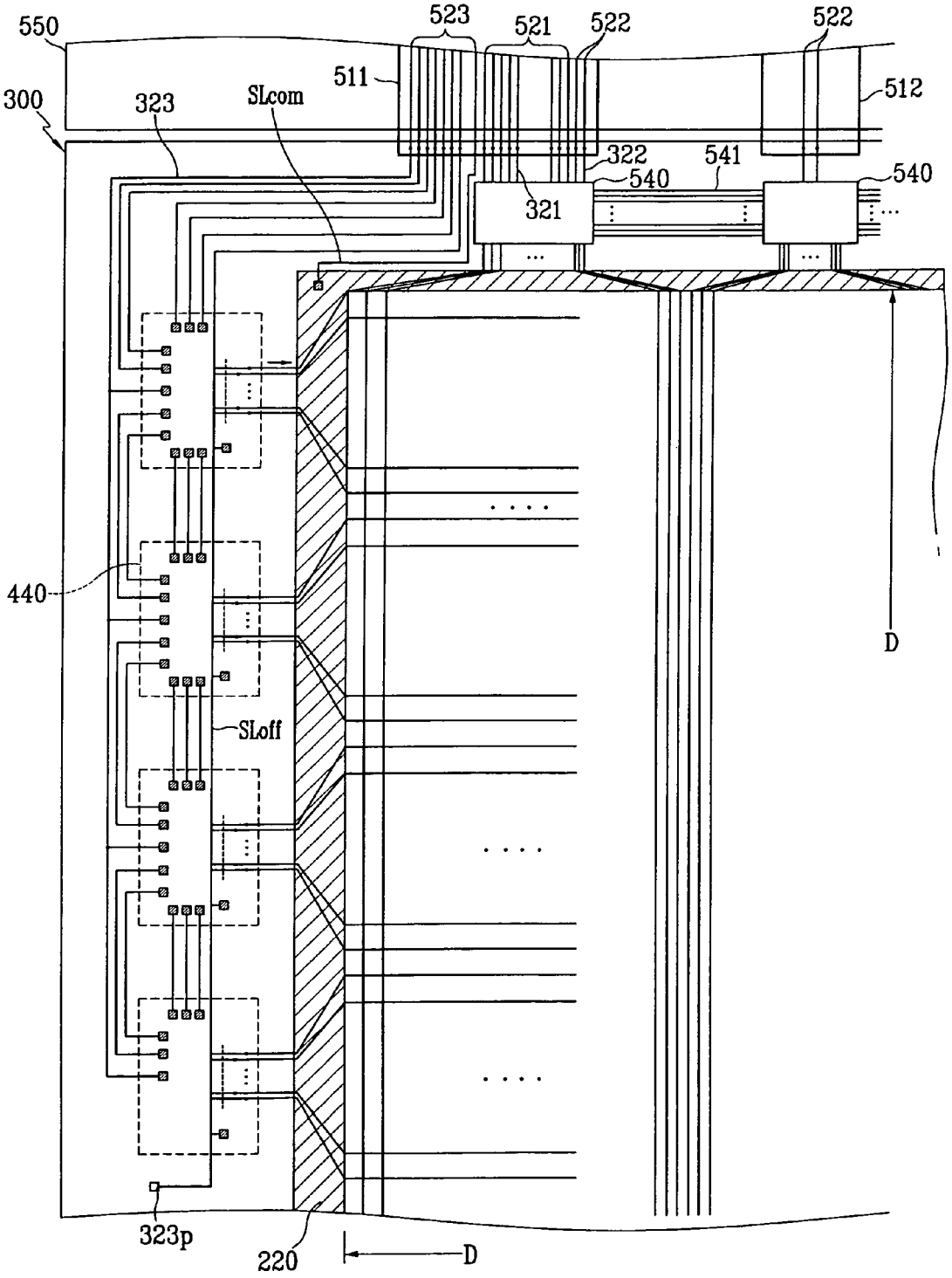
FIG. 3 is a schematic layout view of an LCD according to an embodiment of the present invention.

FIG. 3 is a schematic layout view of an LCD according to an embodiment of the present invention. Referring to FIG. 3, a PCB 550 may include a plurality of circuit elements (not shown), such as the signal generator 600, the driving voltage generator 700, the common voltage generator 750, and the gray voltage generator 800. The PCB 550 is positioned at the top of the panel assembly 300 and may be physically and electrically connected to the panel assembly 300 via a plurality of flexible printed circuit (FPC) films 511 and 512.

The gate driver 400 and the data driver 500 include a plurality of gate driving integrated circuits (ICs) 440 and a plurality of data driving ICs 540 mounted on the panel assembly 300, respectively.

The FPC film 511 includes a plurality of data transmission lines 521 and a plurality of driving signal lines 522, 523 formed thereon. The data transmission lines 521 are connected to input terminals of the data driving ICs 540 via a plurality of leads 321 provided on the panel assembly 300 and transmit image data from the signal controller 600 to the data driving ICs 540. The driving signal lines 522, 523 transmit voltages and control signals required for operation of the gate and data driving ICs 440, 540 to the gate and data driving ICs 440, 540 via a plurality of leads 322 and additional driving signal lines 323 provided on the panel assembly 300.

The FPC film 512 includes driving signal lines 522 formed thereon, which transmit driving signals and control signals to the data driving ICs 540 connected thereto. For example, the driving signal lines 522 may carry gray voltages from the gray voltage generator 800 to the data driving ICs 540.

The data transmission lines 521 and driving signal lines 522, 523 are connected to the circuit elements on the PCB 550 and receive signals therefrom. The driving signal lines 523 also may be provided on a separate FPC film (not shown).

Referring to FIG. 3, a plurality of pixel areas defined by the intersections of the gate lines $G_1$-$G_n$ and the data lines $D_1$-$D_m$ form a display area D on the panel assembly 300. A black matrix 220 (indicated by hatched area) for blocking light leakage exterior to the display area D is provided around the display area D.

Although the gate lines $G_1$-$G_n$ or the data lines $D_1$-$D_m$ extend substantially parallel to each other in the display area D, they align close to each other like a hand-held fan in the area around the display area (referred to as a fan-out area) and then align parallel to each other again as they move away from the fan-out area.

The data driving ICs 540 may be mounted near the top edge of the panel assembly 300 outside the display area D and arranged in the horizontal direction. A plurality of interconnections 541 is provided between the data driving ICs 540 to allow for data transmission between the data driving ICs 540.

The gate driving ICs 440 may be mounted near the left edge of the panel assembly 300 outside the display area D and arranged in the vertical direction perpendicular to the data driving ICs 540. The driving signal lines 323 may electrically connect the driving signal lines 523 to the gate driving ICs 440 and to the common electrode 270. As shown in FIG. 3, the driving signal lines 323 include a signal line $SL_{com}$ that contacts the upper panel 200 for transmission of the common voltage $V_{com}$. The driving signal lines 323 may also electrically connect to the gate driving ICs 440 to each other.

The driving signal lines 323 further include a signal line $SL_{off}$, which is located adjacent to the display area D and connected to each gate line $G_1$-$G_n$. The signal line $SL_{off}$ includes a test pad 323*p* at its end for use when testing whether gate lines $G_1$-$G_n$ and their corresponding pixels are defective. An inspector may apply a voltage sufficient for turning on the switching element Q (e.g. the gate-on voltage $V_{on}$) to the test pad 323*p* and data test signals to the data lines $D_1$-$D_m$ to examine whether the display is consistent with the test signals.

As described above, the LC panel assembly 300 may include two panels 100, 200. One of the panels 100, 200 may be provided with TFTs, and thereby become a "TFT array panel." For example, the addition of TFTs to the lower panel 100 will result in TFT array panel 100 and the driving signal lines 323, the leads 321, 322 and the interconnections 541 may be disposed on TFT array panel 100. The present invention, however, is not limited to use on a TFT array panel, but may be applied to any suitable LC panel assembly known in the art.

Figure 4:
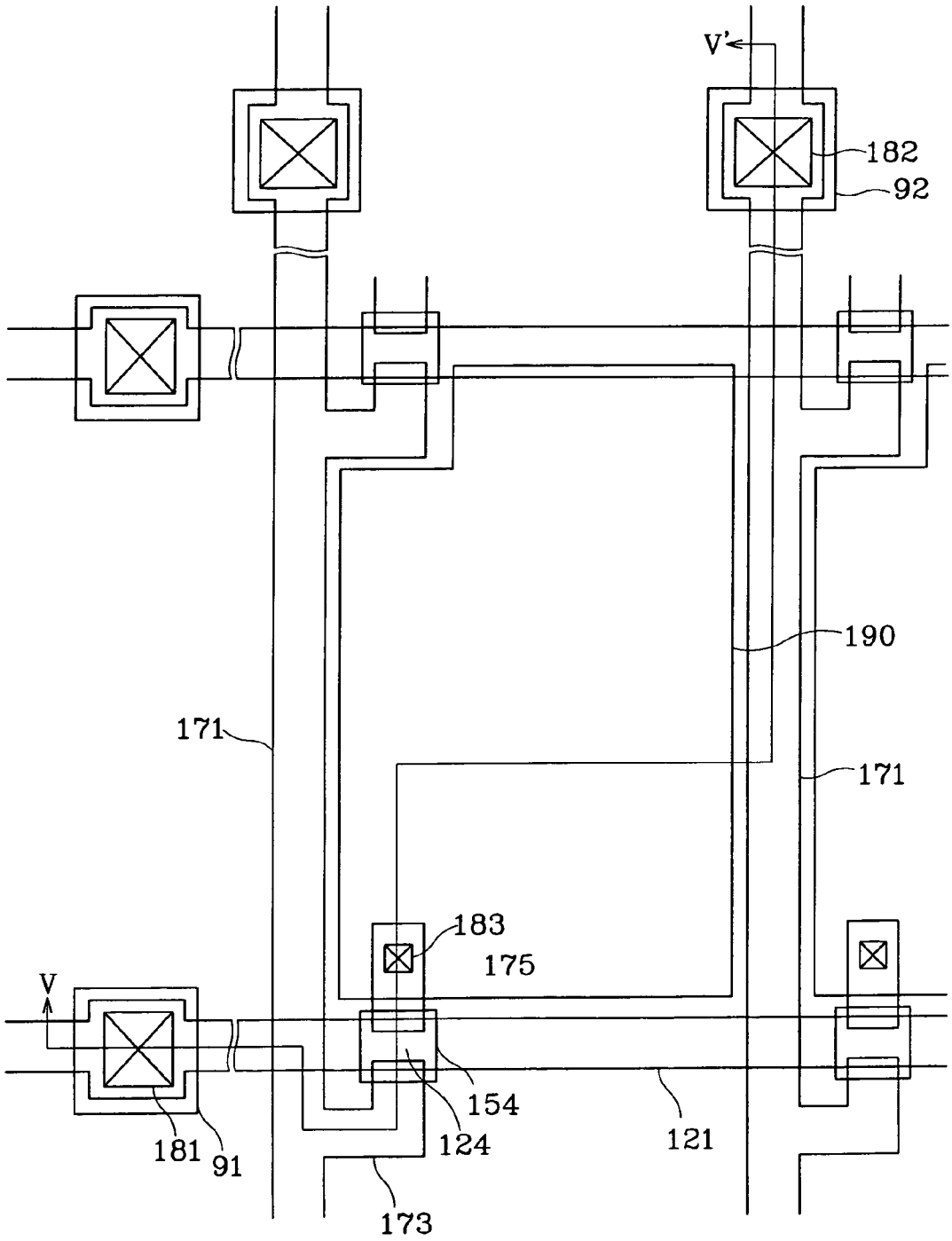
FIG. 4 is a layout view of a TFT array panel for an LCD according to an embodiment of the present invention.

FIG. 4 is a layout view of a TFT array panel for an LCD according to a preferred embodiment of the present invention.

Figure 5:
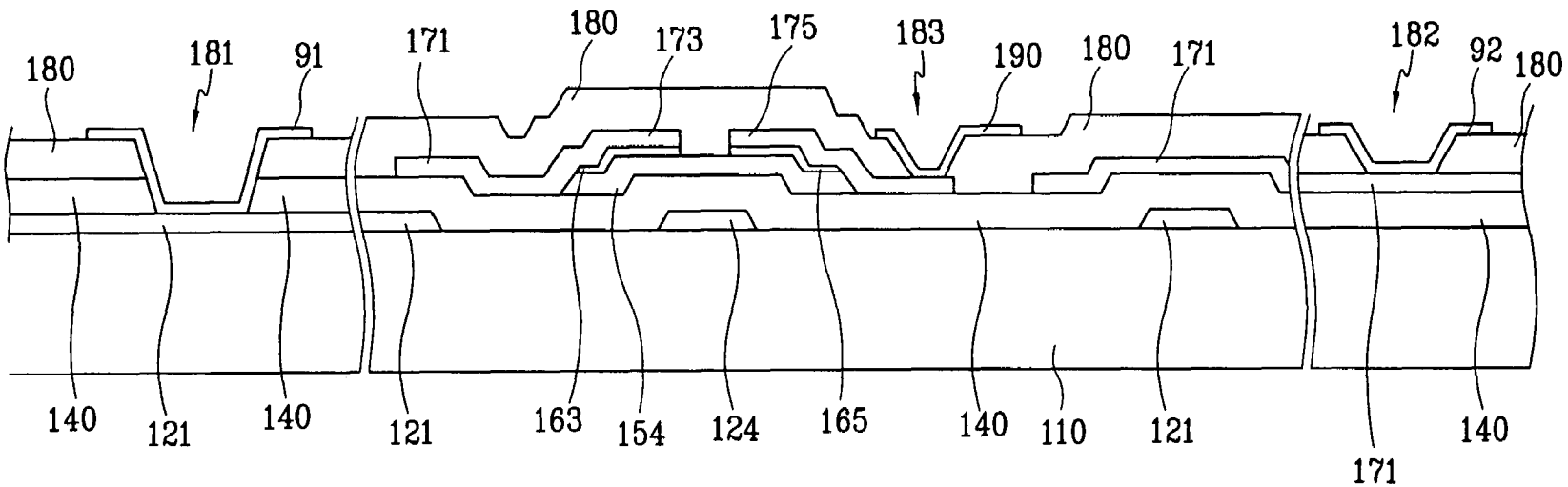
FIG. 5 is a sectional view of the TFT array panel shown in FIG. 4 taken along the line V-V'.
Figure 6:
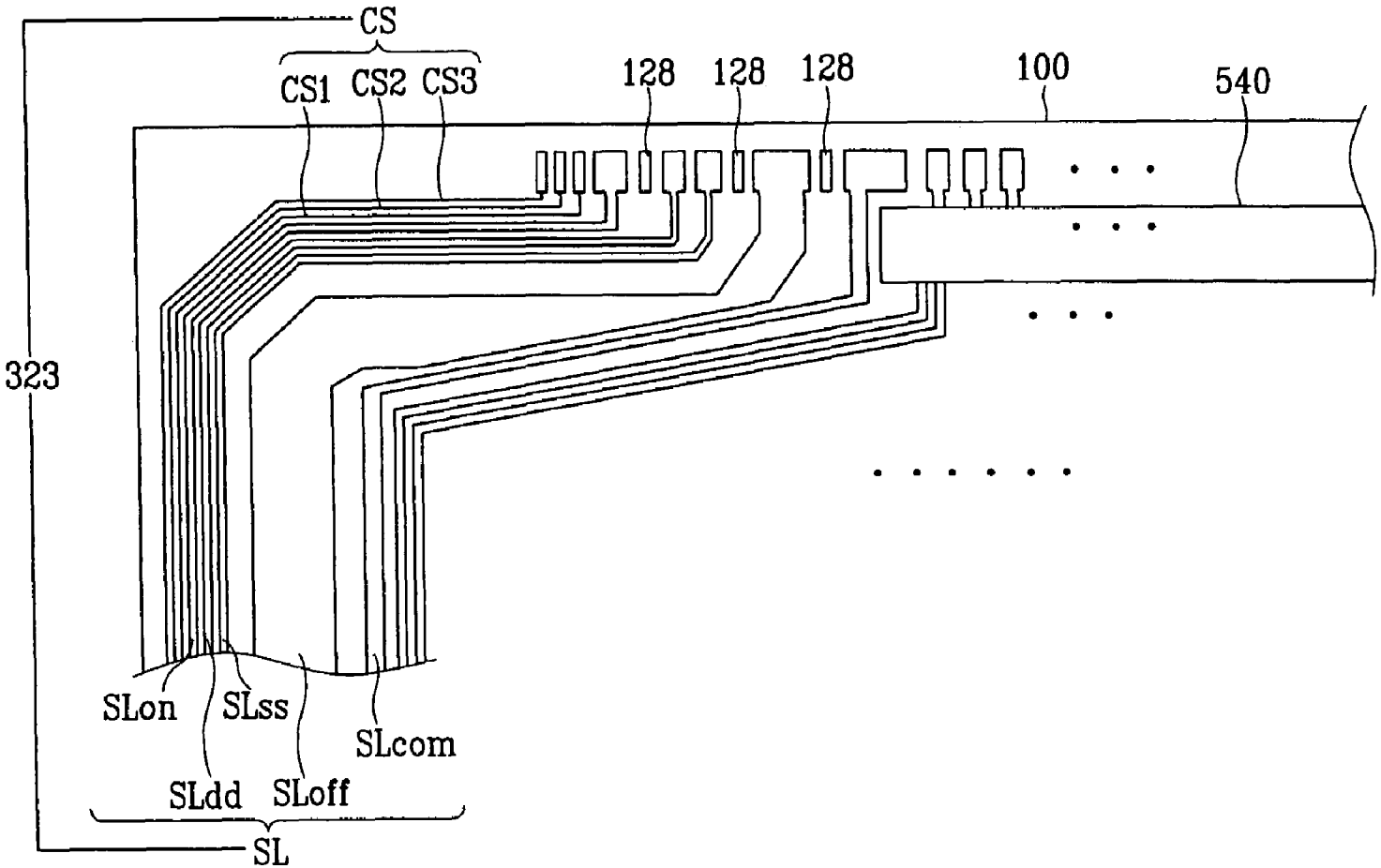
FIG. 6 is an enlarged partial view of a TFT array panel according to an embodiment of the present invention.
Figure 7:
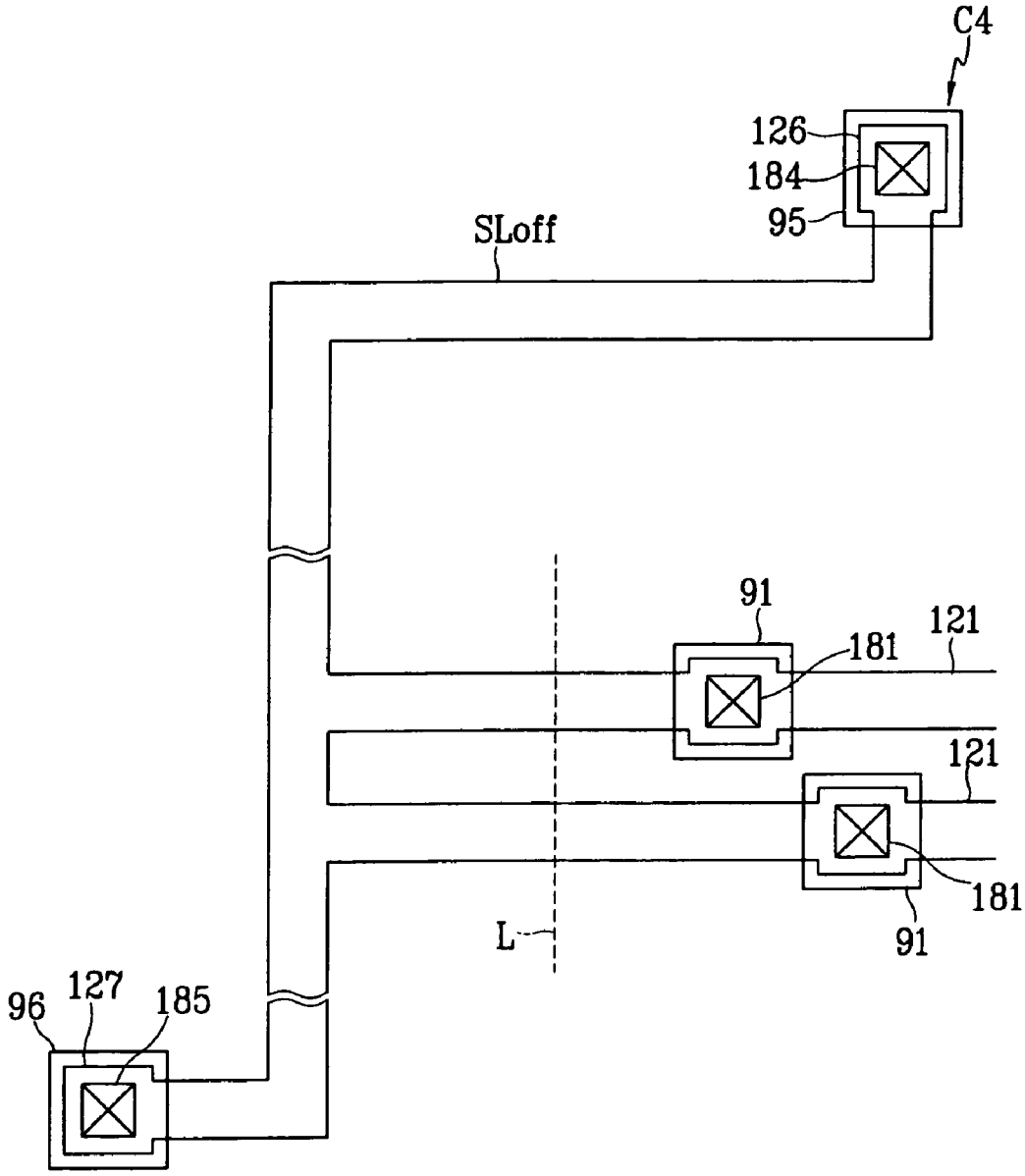
FIG. 7 is an enlarged layout view of a voltage transmission line for transmitting a gate-off voltage and connections between the voltage transmission line and gate lines according to an embodiment of the present invention.

Referring to FIG. 4, enlarged views of gate lines 121, data lines 171 and their intersections are shown. FIG. 5 is a sectional view of the TFT array panel shown in FIG. 4 taken along the line V-V'. FIG. 6 is an enlarged partial view of a TFT array panel according to a preferred embodiment of the present invention, which illustrates the upper left corner of the TFT array panel of FIG. 4. FIG. 7 is an enlarged layout view of a voltage transmission line for transmitting the gate-off voltage $V_{off}$ and connections between the voltage transmission line and gate lines according to a preferred embodiment of the present invention.

A plurality of gate lines 121, a plurality of driving signal lines 323, a plurality of leads 321, 322 and a plurality of interconnections 541 are preferably made of a metal conductor such as Al, Al alloy, Mo, MoW, Cr and Ta. The gate lines 121 extend substantially in a row direction. As shown in FIG. 5, the gate lines 121 are disposed on a substrate 110 and portions of each gate line 121 form gate electrodes 124.

Referring to FIG. 6, the driving signal lines 323 include a plurality of voltage transmission lines SL, which continuously carry predetermined voltages and are positioned innermost from the edge of the panel 100, and a plurality of control signal lines CS positioned adjacent to and on the outside of the voltage transmission lines SL closer to the edge of the panel. The voltage transmission lines SL may include a common voltage transmission line $SL_{com}$, a gate-off voltage transmission line $SL_{off}$, a ground voltage transmission line $SL_{ss}$, a supply voltage transmission line $SL_{dd}$ and a gate-on voltage transmission line $SL_{on}$, which may be sequentially arranged, according to their carrying voltage, from the an innermost position away from the edge of the panel 100 to a position closer to the edge of the panel 100. The control signal lines CS may include a vertical synchronization start signal line CS1, an output enable signal line CS2, a and a gate clock signal line CS3. Voltage transmission and control signal lines SL, CS may be added or omitted and the arranging sequence of the lines SL, CS is not limited to that shown in FIG. 6.

According to the preferred embodiment of the present invention, the voltage transmission lines $SL_{off}$, $SL_{ss}$, $SL_{dd}$ and $SL_{on}$, except for the common voltage transmission line $SL_{com}$, are sequentially arranged depending on the magnitude of the transmitted voltages. That is, the innermost voltage transmission line transmits the lowest voltage, and the outermost voltage transmission lines transmit higher voltages.

For example, a gate-off voltage transmission line $SL_{off}$ transmitting a gate-off voltage $V_{off}$ with a magnitude of about −10V is positioned innermost from the edge of the panel 100, the ground voltage transmission line $SL_{ss}$ transmitting a ground voltage with a magnitude of approximately 0V is arranged next to the gate-off voltage transmission line $SL_{off}$, and the supply voltage transmission line $SL_{dd}$ transmitting a supply voltage with a magnitude of about +3.3V is arranged next to the ground voltage transmission line $SL_{ss}$. The gate-on voltage transmission line $SL_{on}$ transmitting a gate-on voltage $V_{on}$ having a magnitude of about +20V is positioned outermost of the voltage transmission lines.

According to another embodiment of the present invention, the arranging sequence of the voltage transmission lines $SL_{off}$, $SL_{ss}$, $SL_{dd}$ and $SL_{on}$ may be reversed.

According to another embodiment of the present invention, the control signal lines CS are disposed at the same position as the supply voltage transmission line $SL_{dd}$ since the value of the control signals is about +3.3V, which is the same as the supply voltage. For example, the control signal lines CS may be disposed between the ground voltage transmission line $SL_{ss}$ and the supply voltage transmission line $SL_{dd}$ or between the supply voltage transmission line $SL_{dd}$ and the gate-on voltage transmission line $SL_{on}$. The supply voltage transmission line $SL_{dd}$ also may be interposed between the control signal lines CS.

As shown in FIG. 6, the voltage transmission lines SL have larger widths than the control signal lines CS. In particular, the gate-off voltage transmission line $SL_{off}$ has the largest width among the voltage transmission lines SL. As a result, the resistance of the voltage transmission line $SL_{off}$ is the smallest among the voltage transmission lines. The width of the gate-off voltage transmission line $SL_{off}$ is wider near spaces between the fan-out areas.

The driving signal lines 323 have wide pads at their upper end for electrical connection with the driving signal lines 523 of the FPC film 511.

FIG. 7 shows an enlarged view of the gate-off voltage transmission line $SL_{off}$. The gate-off voltage transmission line $SL_{off}$ includes a pad 126 with a larger width than the gate-off voltage transmission line $SL_{off}$ at its upper end and a test pad 127 connected to its lower end. Test pad 127 may be the same as or similar to test pad 323*p*. The gate-off voltage transmission line $SL_{off}$ is connected to all the gate lines 121 ($G_1$-$G_n$) to allow for defect testing of the connected gate lines 121.

As shown in FIG. 6, a plurality of isolated pads 128 are provided between the pads 126 of the driving signal lines 323. The isolated pads 128 are electrically connected to a plurality of redundant signal lines (not shown) provided on the FPC film 511. The redundant signal lines have voltages of the same magnitude as that of the higher voltage flowing through the adjacent two signal lines.

The leads 322 connected to the driving signal lines 522 on the FPC films 511, 512 transmit voltages and control signals required for the operation of the data driving ICs 540. The leads 322 are preferably arranged in the same sequential manner as the driving signal lines 323.

The gate lines 121 and the driving signal lines 323 include a single layer or multiple layers. Multiple layers preferably include a layer having a low resistance and a layer having good contact characteristics with other materials. Double layers of Cr and Al alloy, and Mo or Mo alloy and Al are typical examples.

As shown in FIG. 5, a gate insulating layer 140 preferably made of SiNx is formed on the gate lines 121. As shown in FIGS. 4 and 5, a plurality of semiconductor islands 154 preferably made of hydrogenated amorphous silicon (a-Si) are formed on the gate insulating layer 140 opposite the gate electrodes 124. Pairs of ohmic contacts 163 and 165 are formed on the semiconductor islands 154. The ohmic contacts 163 and 165 preferably include silicide or hydrogenated a-Si heavily doped with n-type impurity such as phosphorous (P), and the ohmic contacts 163 and 165 are separated across the gate electrode 124.

Data lines 171 and the drain electrodes 175 are preferably made of a metal conductor such as Al, Al alloy, Mo, MoW alloy, Cr or Ta and formed on the ohmic contacts 163 and 165 and the gate insulating layer 140. The data lines 171 extend substantially in a column direction, and branches of each data line 171 form source electrodes 173. The drain electrodes 175 are positioned opposite the source electrodes 173 with respect to the gate electrodes 124 and are separated from the data lines 171. Like the gate lines 121, the data lines 171 and the drain electrodes 175 include a single layer or multiple layers. The multiple layers preferably include a layer having a low resistance and a layer having good contact characteristics with other materials.

The gate electrodes 124, the source and drain electrodes 173, 175, and the semiconductor islands 154 form TFTs.

A passivation layer 180 is preferably made of SiNx or an organic insulator and formed on the data lines 171, the source electrodes 173, the drain electrodes 175, and portions of the semiconductor islands 154 and the gate insulating layer 140. The passivation layer 180 includes contact holes 182, 183 exposing portions of the data lines 171 and portions of the drain electrodes 175. The passivation layer 180 and the gate insulating layer 140 also include contact hole 181 exposing portions of the gate lines 121, and contact holes 184, 185 exposing the pads of the driving signal lines 323, for example, pads 126, 127 of the gate-off voltage transmission line $SL_{off}$ (FIG. 7).

As shown in FIGS. 4, 5 and 7, a plurality of pixel electrodes 190 and a plurality of contact assistants 91, 92, 95, 96 are formed on the passivation layer 180. The pixel electrodes 190 and the contact assistants 91, 92, 95, 96 are preferably made of a transparent conductive material such as indium tin oxide (ITO) or indium zinc oxide (IZO).

The pixel electrodes 190 are connected to the drain electrodes 175 through the contact hole 183 and receive the data signals. The contact assistants 91, 92 are connected to end portions of the gate lines 121 and the data lines 171 through the contact holes 181, 182. The contact assistants 91, 92 are provided for protecting exposed end portions of the gate lines 121 and the data lines 171 and complementing adhesion between the end portions and external devices such as driving ICs 440, 540 shown in FIG. 3. The contact assistants 95, 96 are provided for protection and adhesion enhancement and are connected to the pads of the driving signal lines 323, for example the pads 126, 127 of the gate-off voltage transmission line $SL_{off}$, through the contact holes 184 and 185.

Referring to FIG. 6, in operation, the gate-off voltage $V_{off}$ and the gate-on voltage $V_{on}$ are transmitted to the gate driving ICs 440 through the voltage transmission lines $SL_{off}$ and $SL_{on}$ respectively, and the common voltage $V_{com}$ is transmitted to the common electrode 270 of the upper panel 200 through the voltage transmission line $SL_{com}$. The gate control signals CONT1 such as the output enable signal OE, the gate clock signal CPV and the vertical synchronization signal STV are transmitted in parallel to the gate driving ICs 440 through the control signal lines CS.

Referring to FIG. 1, the data driver 500 receives a packet of the image data R', G', B' for a pixel row from the signal controller 600 and converts the image data R', G', B' into analog data voltages selected from the gray voltages supplied from the gray voltage generator 800 in response to the data control signals CONT2 received from the signal controller 600.

Responsive to the gate control signals CONT1 from the signal controller 600, the gate driver 400 applies the gate-on voltage $V_{on}$ to the gate lines 121 ($G_1$-$G_n$), thereby turning on the switching elements Q connected thereto.

The data driver 500 applies the data voltages to the corresponding data lines 171 ($D_1$-$D_m$) for a time period equal to the turn-on time of the switching elements Q (referred to as "one horizontal period" or "1H"). One horizontal period equals one period of the horizontal synchronization signal $H_{sync}$, the data enable signal DE, and the gate clock signal CPV. The data voltages in turn are supplied to the corresponding pixels via the turned-on switching elements Q.

The difference between the data voltage and the common voltage $V_{com}$ applied to a pixel is expressed as a charged voltage of the LC capacitor $C_{LC}$ (i.e., a pixel voltage). The liquid crystal molecules have orientations depending on the magnitude of the pixel voltage and the orientations determine the polarization of light passing through the liquid crystal molecules.

By repeating this procedure, all gate lines $G_1$-$G_n$ may be sequentially supplied with the gate-on voltage $V_{on}$ during a frame. As a result the data voltages may be applied to all pixels during a frame. When a next frame starts after finishing one frame, the inversion control signal RVS applied to the data driver 500 reverses the polarity of the data voltages (referred to as "frame inversion"). The inversion control signal RVS may be set such that the polarity of the data voltages flowing in a data line only are reversed (referred to as "line inversion"), or the polarity of the data voltages in one packet only are reversed (referred to as "dot inversion").

The events in one frame will be described in more detail as follows. After receiving the vertical synchronization signal STV, the first gate driving IC 440 selects the gate-on voltage $V_{on}$ from the two voltages $V_{on}$ and $V_{off}$ received from the driving voltage generator 700 and outputs the gate-on voltage $V_{on}$ to the first gate lines $G_1$. The remaining gate lines $G_2$-$G_{on}$ are supplied with the gate-off voltage $V_{off}$. The switching elements Q connected to the first gate line $G_1$ are turned on upon application of the gate-on voltage $V_{on}$, and the LC capacitors $C_{LC}$ and the storage capacitors $C_{ST}$ for the first pixel row are charged with the pixel voltage. After charging the capacitors $C_{LC}$ and $C_{ST}$ of the first pixel row, the first gate driving IC 440 applies the gate-off voltage $V_{off}$ to the first gate line $G_1$ to turn off the switching elements Q connected thereto, and applies the gate-on voltage $V_{on}$ to the second gate line $G_2$.

By repeating this procedure, the first gate driving IC 440 applies the gate-on voltage $V_{on}$ to all the gate lines connected thereto. Then, the first gate driving IC 440 outputs a carry signal to a second gate driving IC 440 which signals the termination of scanning by the first gate driving IC 440.

The second gate driving IC 440, after receiving the carry signal, scans all the gate lines connected thereto and generates a carry signal to be transmitted to the next gate driving IC 440 upon completion of its scanning.

Once scanning of the last gate driving IC 440 is terminated, one frame is complete.

As described above, for an LCD transmitting the driving voltages and the control signals required for driving the gate and data driving ICs 440, 540 through the leads 322 and driving signal lines 323 provided on the panel assembly 300, the sequential arrangement of the voltage transmission lines SL and the control signal lines CS depending on the carrying voltages reduces the voltage difference between adjacent driving signal lines. The reduced voltage difference in turn decreases corrosion of the signal lines due to the electrolysis generated when a medium for carrying negative charges is permeated into the panel assembly 300.

In addition, since the gate-off voltage transmission line $SL_{off}$, may be located at an innermost position relative to other driving signal lines 323, the gate-off voltage transmission line $SL_{off}$ can have a comparatively large width, thereby reducing resistance and resulting in stable transmission of the gate-off voltage $V_{off}$.

Furthermore, the provision of isolated pads 128, interposed between the pads 126 of two voltage transmission lines SL carrying two different voltages, also aids in the reduction of corrosion of signal lines. The isolated pads 128 are connected to redundant signal lines on the FPC film 511 which transmit the higher one of the two voltages being carried by the two adjacent voltage transmission lines SL. As a result, the voltage difference between the pad of the voltage transmission line SL carrying the lower voltage and the isolated pad 128 is large, and the voltage difference between the pad of the voltage transmission line SL carrying the higher voltage and the isolated pad 128 is substantially zero. Therefore, defects or corrosion of the voltage transmission line SL carrying the higher voltage are prevented at the sacrifice of the isolated pad 128.

The test pads 127, 323*p* at one end of the gate-off voltage transmission line $SL_{off}$ may be used for inspection of the gate lines $G_1$-$G_n$. More specifically, a gate test signal having a voltage sufficient for turning on the switching elements Q such as the gate-on voltage $V_{on}$ is applied to the test pads 127, 323*p* and/or the pads 126 of the gate-off voltage transmission line $SL_{off}$ to turn on the switching elements Q. Upon application of data test signals to the data lines 171 ($D_1$-$D_m$) using a testing device (not shown), the pixels connected to the gate lines 121 ($G_1$-$G_n$) supplied with the gate-on voltage $V_{on}$ should exhibit a brightness corresponding to the data test signals. An inspector may examine the display to determine whether the brightness is consistent with the test signals and if not, whether any defects exist in the gate lines 121 ($G_1$-$G_n$) and the data lines 171 ($D_1$-$D_m$). After completing inspection, the voltage transmission line $SL_{off}$ and the gate lines 121 ($G_1$-$G_n$) are disconnected preferably by using a laser trimming device.

The present invention is also applicable to an LCD including a plurality of FPC films for mounting gate driving ICs and an LCD including a panel assembly having a gate driver and/or a data driver incorporated therein.

The present invention may also be applicable to any electronic device including a plurality of conductive lines transmitting electrical signals.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. A liquid crystal display comprising:

a control voltage generating circuit generating a plurality of control voltages;

a driving voltage generating circuit generating a plurality of driving voltages; and a liquid crystal panel comprising a plurality of control signal transmitting lines, a plurality of driving voltage transmitting lines, a plurality of first pads, and a plurality of second pads, the plurality of first pads being formed at ends of the control signal transmitting lines connected to the control voltage generating circuit and transmitting the control voltages, respectively and the plurality of second pads being formed at ends of the driving voltage transmitting lines connected to the driving voltage generator and transmitting the driving voltages, respectively, wherein some of the control signal transmitting lines and the driving voltage transmitting lines are supplied with voltages having magnitudes different from each other, and the first pads and the second pads are arranged according to the magnitudes of the voltages.

2. The liquid crystal display of claim 1, wherein the first pads and the second pads are sequentially arranged based on increasing magnitudes of the voltages.

3. The liquid crystal display of claim 1, wherein the first pads and the second pads are sequentially arranged based on decreasing magnitudes of the voltages.

4. The liquid crystal display of claim 1, wherein the driving voltages comprise at least one of a common voltage, a gate-off voltage, a gate-on voltage, a ground voltage, and a supply voltage.

5. The liquid crystal display of claim 4, wherein the second pad connected to a driving voltage transmitting line transmitting the gate-off voltage comprises a test pad.

6. The liquid crystal display of claim 5, wherein the liquid crystal panel further comprises a plurality of gate lines, and the test pad is connected to the gate lines.

7. The liquid crystal display of claim 6, wherein the liquid crystal panel further comprises a cutting line cutting between the test pad and the gate lines.

8. The liquid crystal display of claim 1, wherein the control voltages comprise at least one of a vertical synchronization start signal, a gate clock signal, and an output enable signal.

9. The liquid crystal display of claim 1, wherein the liquid crystal panel further comprises an isolated pad interposed between two adjacent pads, wherein the isolated pad is electrically connected to at least one redundant driving signal line and the at least one redundant driving signal line transmits a voltage equal to the higher one of voltages applied to the two adjacent pads.

* * * * *